United States Patent [19]

Hayes et al.

[11] Patent Number: 5,042,444

[45] Date of Patent: Aug. 27, 1991

[54] DEVICE AND METHOD FOR ALTERING THE ACOUSTIC SIGNATURE OF AN INTERNAL COMBUSTION ENGINE

[75] Inventors: Paul A. Hayes; Thomas E. Reinhart; Terrence M. Shaw, all of Columbus, Ind.

[73] Assignee: Cummins Engine Company, Inc., Columbus, Ind.

[21] Appl. No.: 489,528

[22] Filed: Mar. 7, 1990

[51] Int. Cl.[5] ..... F02D 41/16; F02D 17/02

[52] U.S. Cl. ..... 123/339; 123/481; 123/198 F; 123/335

[58] Field of Search ..... 123/192 B, 198 DB, 198 DC, 123/198 F, 335, 339, 416, 418, 476, 478, 479, 481, 612, 617

[56] References Cited

U.S. PATENT DOCUMENTS

| | | | |
|---|---|---|---|
| 4,070,971 | 1/1978 | Studebaker | 123/198 F |
| 4,146,006 | 3/1979 | Garabadian | 123/481 X |
| 4,351,202 | 9/1982 | Summes | 74/604 |
| 4,367,716 | 1/1983 | Yasuhara | 123/478 |
| 4,391,255 | 7/1983 | Staerzl | 123/481 |
| 4,469,071 | 9/1984 | Bassi et al. | 123/481 |
| 4,470,390 | 9/1984 | Omori et al. | 123/481 X |
| 4,509,488 | 4/1985 | Forster et al. | 123/481 |
| 4,519,344 | 5/1985 | Ohyama et al. | 123/55 VF |
| 4,530,332 | 7/1985 | Harvey et al. | 123/481 |
| 4,541,387 | 9/1985 | Morikawa | 123/481 |
| 4,550,704 | 11/1985 | Barho et al. | 123/482 |
| 4,552,114 | 11/1985 | Sano et al. | 123/481 |
| 4,556,026 | 12/1985 | Masuda et al. | 123/198 F |
| 4,608,952 | 9/1986 | Morita et al. | 123/198 F |
| 4,640,241 | 2/1987 | Matsunaga | 123/198 F |
| 4,722,308 | 2/1988 | Wall | 123/198 F |
| 4,727,844 | 3/1988 | Morita et al. | 123/339 X |
| 4,794,893 | 1/1989 | Masuda et al. | 123/90.17 |

*Primary Examiner*—Willis R. Wolfe

*Attorney, Agent, or Firm*—Woodard, Emhardt, Naughton, Moriarty & McNett

[57] ABSTRACT

An apparatus and method for altering the acoustic signature of an internal combustion engine is disclosed. Several techniques for altering the acoustic signature of an engine are shown, including time-varying, disabling or cutout of individual cylinders of an engine in a random fashion in order to reduce the periodic characteristics of the exhaust noise of the engine. Alternate embodiments include offsetting crank pins to transform an even firing engine into an uneven firing engine, inhibiting the fueling of individual cylinders, and inhibiting the ignition signals provided to individual cylinders. A combination of the above techniques may also be implemented in order to disperse the exhaust noise energy present over a wide frequency range, making acoustic detection of the exhaust signature difficult. Cylinder cutout schemes are implemented over a single or multiple engine cycle to disperse exhaust noise pulses over time and randomize measurable spectral noise composition.

24 Claims, 5 Drawing Sheets

DEVICE AND METHOD FOR ALTERING THE ACOUSTIC SIGNATURE OF AN INTERNAL COMBUSTION ENGINE

BACKGROUND OF THE INVENTION

This invention relates to internal combustion engines and more specifically to devices and methods for altering the acoustic signature of such engines.

A major concern of military operations in the field is the acoutic detection of their fighting vehicles by enemy forces. Engine exhaust noise is the dominant source of noise under idle conditions. Tread noise dominates when vehicles (e.g. tanks) are in motion. The low frequency exhaust pulses of an idling engine are particularly easy to recognize with a simple spectrum analyzer and a microphone.

The periodic nature of the engine exhaust noise at idle results in an audio frequency spectrum dominated by the firing frequency and its harmonics. Internal combustion engines, particularly Otto and Diesel cycle engines, will have a characteristic periodic exhaust noise which includes the firing frequency and higher order harmonics of the firing frequency dependent upon a number of engine parameters. Design parameters such as number and arrangement of cylinder, cylinder dimensions and displacement, exhaust valve design, muffler dynamics and others influence the characteristic exhaust noise emanating from a vehicle. As is well knwon in the art, for every two revolutions of the crankshaft of a four-cycle Otto or Diesel cycle engine, a firing cycle is completed. Thus, an engine idling at 480 RPM will repeat a particular firing pattern and produce a repeatable "noise signature" four times a second. Accordingly, a two-cycle engine idling at 480 RPM repeats its firing pattern eight times a second.

Some engine designs result in uneven or nonuniform firing patterns as a result of the crank pin locations of the crankshaft. Many engines include an uneven firing sequence due to design limitations relating to the number of cylinders and the angle between banks of cylinders, such as is found in a common 90° V-6 engine, which results in an uneven firing engine. An example of an even firing engine serves to illustrate what is meant by an uneven firing engine. In an even firing eight-cylinder engine, a power stroke occurs for each 90 degrees of rotation of the crankshaft of the engine. This is easily determined by knowing the number of cylinders (eight), the fact that a power stroke occurs once for each cylinder over two revolutions of the crankshaft, and that distributing eight power strokes evenly over two revolutions results in a power stroke every 90 degrees to produce even firing engine operation. Thus, it follows that an uneven firing engine does not produce a power stroke at a fixed crankshaft rotational increment.

A device and method for producing a variable idle speed for an internal combustion engine are shown, for example, in copending application Ser. No. 489,684, by P. Hayes and T. Reinhart filed concurrently herewith, titled "Method and Device for Variable Idle Speed Control of an Internal Combustion Engine", the disclosure of which is hereby incorporated by reference.

A method and device for altering the acoustic signature of an engine is needed to prevent audio frequency spectrum identification of military vehicles by enemy forces.

SUMMARY OF THE INVENTION

In accordance with one aspect of a device for altering the acoustic signature of an internal combustion engine having at least two cylinders, the device comprises power output sensing means for producing a low-load signal when the power request to the engine falls below a predetermined load limit, and cylinder cutout means responsive to the low-load signal for enabling and disabling the cylinders of the engine in a time-varying fashion.

According to another aspect of the invention, a method for altering the acoustic signature of an internal combustion engine having a plurality of cylinders comprises the steps of detecting a low-load condition placed on the engine and cutting out normal operation of at least one of the plurality of cylinders in a time-varying fashion in response to detecting the low-load condition.

One object of the present invention is to alter the characteristic exhaust noise of an internal combustion engine.

Another object of the present invention is to provide a time-varying alteration of the exhaust noise emanating from an internal combustion engine thereby preventing noise signature identification of the engine.

These and other objects of the present invention will become apparent from the following description of the preferred embodiment.

DESCRIPTION OF THE PREFERRED EMBODIMENT

Figure 1:
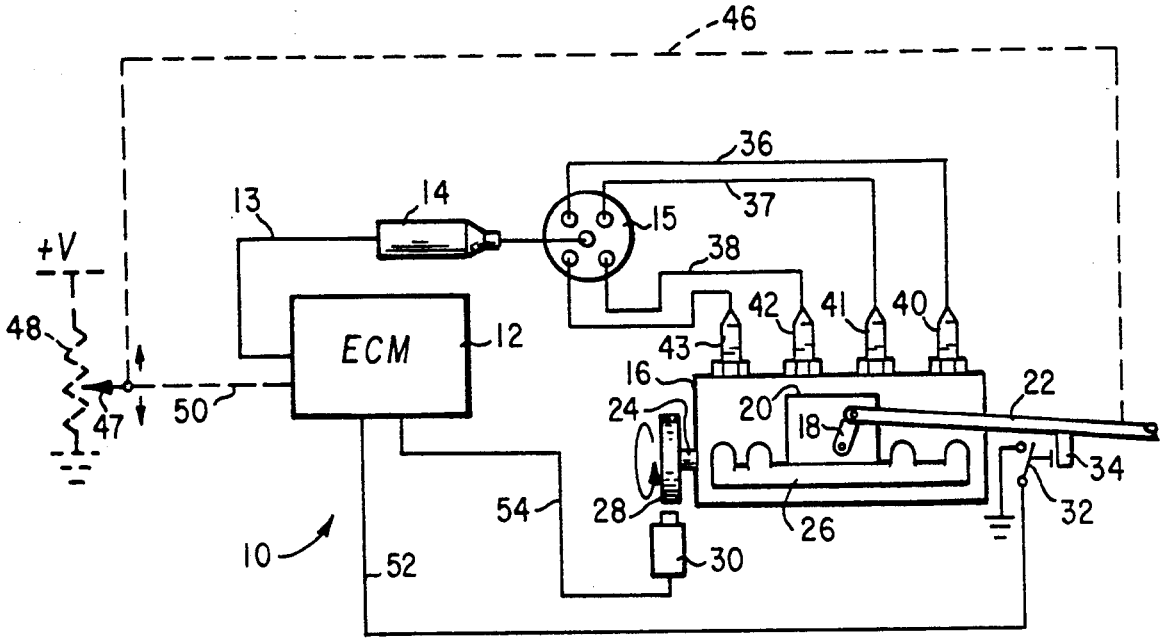
FIG. 1 is a diagrammatic illustration of one embodiment of the present invention including an ignition cutout device.

For the purposes of promoting an understanding of the principles of the invention, reference will now be made to the embodiment illustrated in the drawings and specific language will be used to described the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to FIG. 1, one embodiment of a device 10 for altering the noise signature of an internal combustion engine according to the present invention is shown. The device 10 includes engine control module 12 which provides an ignition signal to coil 14 via signal path 13. The electronic control module or ECM 12 receives an input signal from switch 32 via signal path 52 and from sensor 30 via signal path 54.

Distributor 15 receives a high voltage signal from coil 14 and distributes the high voltage ignition signal to spark plugs 40–43 which are connected to distributor 15 by way of signal paths 36–39, respectively. Spark plugs 40–43 are installed in engine 16 which includes carburetor 20, crankshaft 24, flywheel 28, intake manifold 26, carburetor throttle control arm 18 and throttle linkage 22. Throttle linkage 22 includes a member 34 extending therefrom which actuates switch 32 when throttle linkage 22 is in an idle speed position.

ECM 12 includes a microprocessor and a plurality of analog and digital I/O circuitry for monitoring and controlling various aspects of engine operation. In addition to analog to digital (A/D) converters and digital to analog (D/A) converters, ECM 12 includes signal conditioning circuitry for digital I/O signal interfacing with sensors and ECM actuated devices.

Operationally speaking, ECM 12 monitors the operating conditions of engine 16 and responds to the input signals received on signal paths 52 and 54. An idle state of operation for engine 16 is sensed when normally open switch 32 is closed. This occurs when throttle linkage 22 is placed in a position corresponding to a request for a low or reduced power output state of operation from engine 16. When ECM 12 detects switch 32 is closed, the ECM 12 responds by intermittently in a time-varying fashion momentarily disabling the ignition signals supplied to coil 14 via signal path 13. As a result of an interruption of ignition signals to coil 14, the ignition signals supplied to spark plugs 40–43 via distributor 15 are selectively and momentarily inhibited, thereby creating an aperiodic exhaust noise response by eliminating selected power pulses from the exhaust noise. The eliminated power pulses correspond to the inhibited ignition signals determined according to algorithms resident in the ECM 12 software.

Electronic control module (ECM) 12 determines appropriate timing information for supplying ignition signals to coil 14 from sensor 30. Sensor 30 provides timing information by detecting movement of flywheel 28 which is mounted on and rotates in conjunction with crankshaft 24. Several well known techniques are used to detect rotational speed of a flywheel such as flywheel 28. These techniques need not be fully discussed at this juncture, however magnetic and optical sensing devices are commonly implemented for the sensor 30. Flywheel 28 normally includes teeth around the circumference of the flywheel or magnets positioned at strategic angularly spaced locations about the circumference of the flywheel 28 and are detected as they pass near sensor 30. Either the tooth or the magnet sensing technique provides the appropriate timing information to ECM 12 for ignition signal synthesis. In addition, the engine speed or RPM can be determined from the signal produced by sensor 30 and supplied to ECM 12 via signal path 54.

Alternate forms of an electronic ignition system may include multi-lobed cams (not shown) within distributor 15 which are gear driven from the crankshaft of the engine. The lobes of the cam are situated and aligned for producing appropriate timing information for ignition signals to the cylinders of the engine, which technology is well known in the engine art. An ignition timing signal is generated when a lobe of the cam passes near a stationary magnetic sensor or pick-up (not shown). The timing signal triggers a circuit to supply an ignition switching signal to the primary of the ignition coil. Momentary inhibition of the timing signal or the switching signal produces cylinder cutout via disabling or inhibiting ignition signals.

In an alternate embodiment of the device 10 shown in FIG. 1, switch 32 is not required, as potentiometer 48 with its wiper 47 mechanically coupled to linkage 22, provides an analog input signal to ECM 12 via signal path 50 indicative of the relative position of the linkage 22. The position of linkage 22 corresponds to a continuously variable engine power output request from the operator. Accordingly, when the voltage on signal path 50 is within a predetermined range, i.e. zero to two volts, ECM 12 is informed that the throttle linkage 22 is in a position wherein a low power output state of operation of engine 16 has been requested by the operator. Thus, in response to a request for low power output from the engine, ECM 12 executes the acoustic signature alteration software routines whereby ignition signals to the spark plugs 40–43 are momentarily inhibited in a time-varying fashion so as to produce an aperiodic exhaust noise.

A mass air flow sensor (not shown) provides an alternate means for detecting a low power engine output request. Such sensors are commonly used to detect air flow into the air intake of an electronically fuel-injected engine. Air flow sensors provide an electrical output signal corresponding to the mass of the air passing the sensing element of the sensor. The ECM 12 uses the air flow sensor output signal to detect low power output requests and responds by cutting cylinders out of operation via inhibition of ignition signals or inhibition of fueling signals to injectors 70–75 as shown in FIG. 2.

Figure 2:
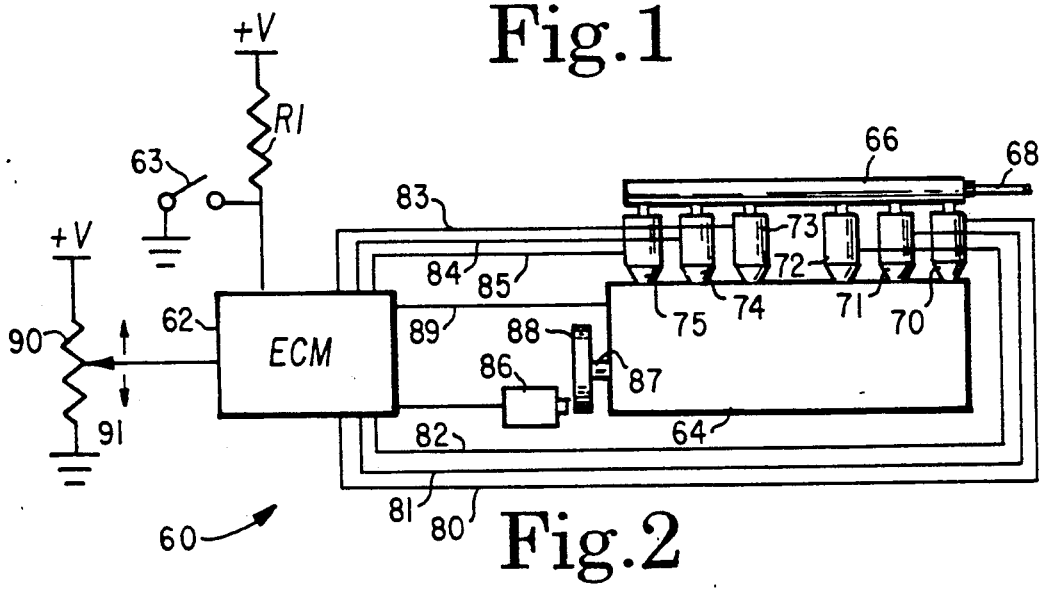
FIG. 2 is a diagrammatic illustration of another embodiment of the present including a fueling control cutout device.

Referring now to FIG. 2, another embodiment of a device 60 for altering exhaust noise and thereby altering the acoustic signature of an internal combustion engine is shown. Device 60 includes electronic control module (ECM) 62, control lines 80–85 which directly control the actuation of electrically controlled fuel injectors 70–75, respectively. ECM 62 includes a similar complement of I/O hardware as contained in ECM 12. Pressurized fuel rail 66 supplies pressurized fuel to injectors 70–75. Pressurized fuel is supplied to the injector rail 66 via fuel supply line 68. Potentiometer 90, including wiper 91, is connected to an input of ECM 62. Wiper 91 is positioned proportionally in accordance with the position of the throttle linkage (not shown) controlled by an operator. The throttle linkage is positioned according to the power output desired by the operator from engine 64. Wiper 91 moves in proportion to and in accordance with the throttle linkage to produce an analog signal, supplied to an input of ECM 62, indicative of the throttle position or power requested from engine 64. When wiper 91 is in a position representative of a request for a low power output state of engine operation in response to low-load conditions, ECM 62 responds by momentarily altering or inhibiting fuel rate or quantity control signals supplied to injectors 70–75 via control lines 80–85 in a time-varying fashion. Altering, in a time-varying fashion, the duration of injector fuel delivery signals accordingly alters the magnitude of individual noise pulses produced by the corresponding power stroke for a particular cylinder. To maintain a constant idle speed, ECM 62 must increase fuel delivery to active cylinders when other cylinders are cut out of normal operation as a result of lower or inhibited fuel delivery rates to the cut out cylinders.

Typically, camshaft and crankshaft timing signals are necessary for determining when to actuate electronic fuel injectors. Mechanical fuel injection systems do not require such timing sensors, as is well known in the art. Timing or synchronization signals for actuation of the fuel injectors 70–75 are provided by sensor 86 which supplies signals to ECM 62 indicative of the relative position of crankshaft 87. Camshaft timing signals are produced by a sensor (not shown) within engine 64 which supplies a signal to ECM 62 via signal path 89 indicative of camshaft position. Camshaft rotational position sensing occurs in a manner similar to the interaction of sensor 86 and flywheel 88. Gear teeth (not shown) around the perimeter of flywheel 88, mounted on crankshaft 87, act as a tone wheel to interact magnetically or optically with sensor 86 to provide crankshaft timing information necessary for properly timed actuation of injectors 70–75. In an Otto cycle engine, the fuel injectors 70–75 are activated during an intake cycle. If the engine of FIG. 2 is a Diesel engine, the injectors 70–75 are activated just prior to top dead center of a compression stroke during normal injector operation.

Switch 63 supplies an enable/disable digital signal to an input of ECM 62. The position of switch 63 is under operator control. If the operator wishes to disable engine cutout operation, switch 63 is positioned to supply a logic signal to ECM 62 indicating such. Resistor R1 ensures that the enable/disable input signal is always high if switch 63 is open.

The device 60 shown in FIG. 2 is an alternative embodiment for altering exhaust noise and thereby altering the acoustic noise signature of an engine. The embodiment of FIG. 1 provides for ignition signal suppression, whereas the embodiment of FIG. 2 provides for fueling control. Inhibiting ignition signals, altering fuel delivery rates to different cylinders and inhibiting fuel delivery to certain cylinders provides for cylinder cutout means necessary for cutting out or suppressing one of a plurality of cylinders in a time-varying fashion to produce an aperiodic exhaust noise.

Figure 3:
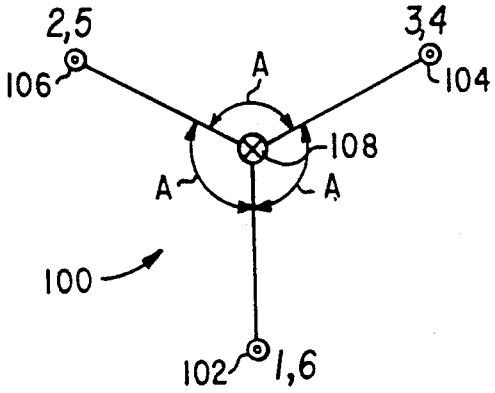
FIG. 3 is a diagrammatic illustration of the crank pin positions for an even firing engine as viewed along a centerline end view of the crankshaft.

Referring now to FIG. 3, a diagrammatic illustration of an end view of a crankshaft 100 is shown. The centerline of the crankshaft is indicated by position 108 which has an "x" therein. Position 108 is the rotational axis of the crankshaft 100. Locations 102, 104, and 106 are the crank pin locations for cylinders 1–6. Crank pin locations for cylinders 1 and 6 is location 102. Crank pin locations for cylinders 2 and 5 is location 106. Crank pin locations for cylinders 3 and 4 is location 104.

The diagrammatic representation of the crankshaft 100 discloses firing angles A which are equivalent. In the case of a six-cylinder engine having equal firing angles, one cylinder of the engine will fire every 120 degrees. This angular relationship corresponds with angle A. In an even firing engine, the exhaust noise is periodic in nature in that for every 120 degrees of rotation of the crankshaft, a firing stroke occurs for one of the cylinders of the six-cylinder engine. Thus, if the crankshaft 100 is rotating at a speed of 600 RPM, three power strokes will occur for each revolution of the crankshaft. For each power stroke, a noise pulse emanates from the exhaust system of the engine. It is highly desired in most applications that engines have an even firing operation for vibrational reasons. Thus, the representation of FIG. 3 would correspond to a normal in-line six-cylinder engine crankshaft.

Figure 4:
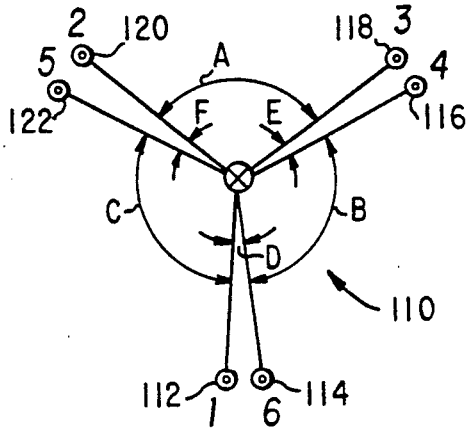
FIG. 4 is a diagrammatic illustration of the crank pin positions of an uneven firing engine showing the angular relationships of the crank pins from the perspective of the centerline of the crankshaft.

Referring now to FIG. 4, a centerline view of a crankshaft 110 having offset crank pin angles is shown. The illustration is similar to the one shown in FIG. 3 with the exception that each individual cylinder has a crank pin angle offset from the standard 120 degrees in order to produce nonuniform time periods between power strokes, and thereby disperse the spectral energy produced by the exhaust noise of an engine containing the crankshaft 110. Thus, angles A, B, and C will be something less than 120 degrees, typically 100 to 119 degrees, and angles D, E, and F will be in the range of 1 to 20 degrees. The crank pin position for cylinder 1 is represented by location 112. The crank pin position for cylinder 6 is represented by location 114. The crank pin position for cylinder 4 is represented by location 116. And such is the case for the remaining crank pins 3, 2, and 5 corresponding to cylinders 3, 2, and 5 and locations 118, 120, and 122, respectively.

With a firing order of 1, 2, 4, 6, 5, 3, it can be seen from the diagram of crankshaft 110 that the exhaust noise for an engine running at a steady speed or RPM will include bursts of noise that are variably related in time based upon the variations in the crank pin angles A–F of FIG. 4. Such offset crank pins serve to produce a time-varying power stroke and thus a time-varying exhaust pulse noise produced by the engine. In addition, it is recognized that this approach modifies the exhaust noise spectrum of the engine at all speeds and loads.

By incorporating the crankshaft illustrated in FIG. 4 into the embodiments of FIG. 1 or FIG. 2, it is readily seen that a combination of approaches for altering exhaust noise results. Offset crank pins incorporated into the crankshaft of FIG. 1 provide for offset crank pin firing pulses as well as intermittent ignition signals to produce increased dispersion of energy in the frequency domain for the exhaust noise of the embodiment shown in FIG. 1. Although the diagrammatic illustration of FIG. 4 represents a six-cylinder engine, it should be readily understood from the explanation of the offset crank pins of FIG. 4 how the crank pin offsets for any multi-cylinder crankshaft can be adjusted in accordance with the technique described in relation to the crankshaft of FIG. 4.

The crankshaft of FIG. 4 may also be used with the embodiment shown in FIG. 2 to provide increased dispersion of exhaust noise pulses in a time-varying fashion. Uneven firing from offset crank pins coupled with cylinder fueling cutout control decreases the periodic nature of the exhaust noise and increases the dispersion of energy throughout the frequency spectrum, thereby disguising the engine exhaust noise.

Figure 5:
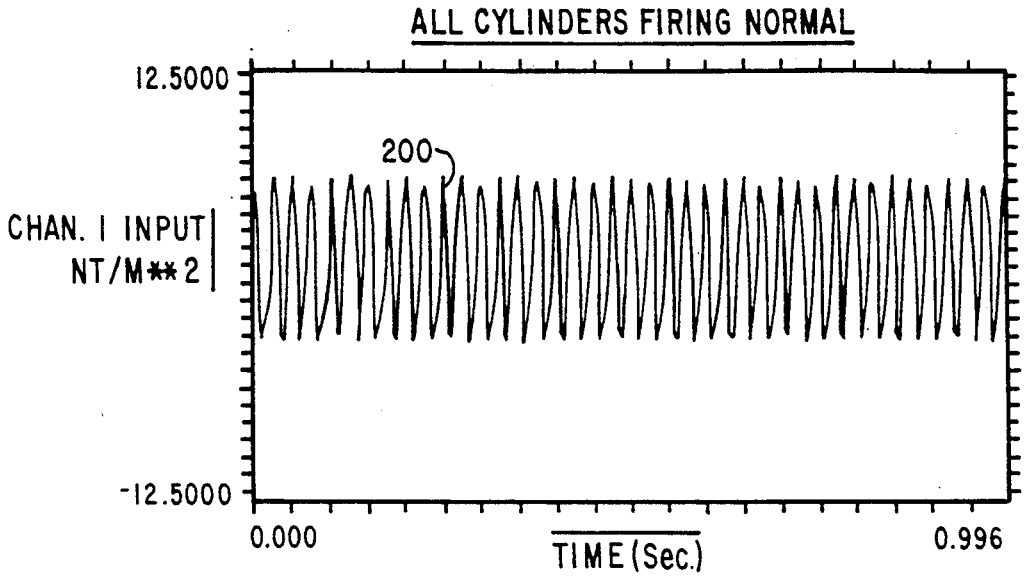
FIG. 5 is a computer simulated graph corresponding to the exhaust noise produced by an internal combustion engine with all cylinders firing normally.

Referring now to FIG. 5, a graph is shown for a computer simulated exhaust noise or sound pressure modeled from the actual noise measured near the exhaust pipe outlet of a running model 88NT Diesel engine manufactured by Cummins Engine Company, Inc., of Columbus, Ind. The 88NT Cummins engine is an in-line, six-cylinder, Diesel engine with even firing and produces exhaust noise as shown by the curve 200. The curve of FIG. 5 depicts a normal firing engine exhaust noise with all cylinders firing.

Figure 6:
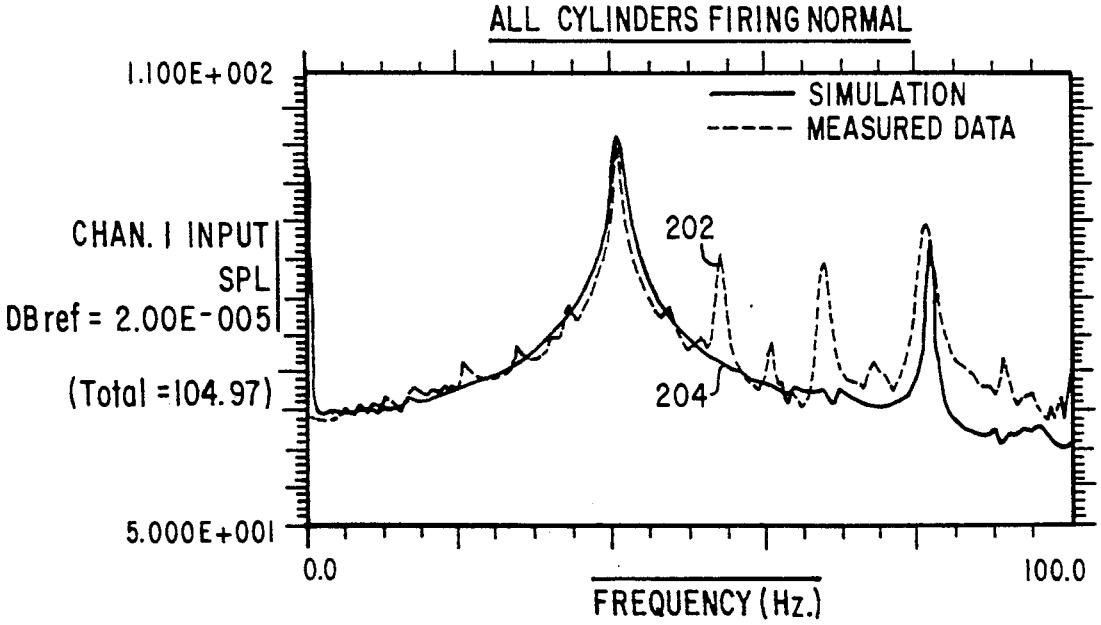
FIG. 6 is a frequency plot for the time-varying signal shown in FIG. 5 including a simulated and a measured response curve.

Referring now to FIG. 6, a spectral analysis of the curve 200 of FIG. 5 is shown. Curve 202 represents a laboratory measured spectral analysis, and curve 204 is a computer generated plot of the spectral composition of the curve 200. Curve 202 was created using a spectrum analyzer and a microphone to measure the sound pressure levels produced by the exhaust noise of a Cummins model 88NT engine. As is readily seen from the spectral plots of FIG. 6, the firing frequency at 40 Hz is easily identified, thus an even firing engine with all cylinders firing can be easily identified by analyzing the audio frequency spectral composition of the characteristic exhaust noise at a constant engine speed.

Figure 7:
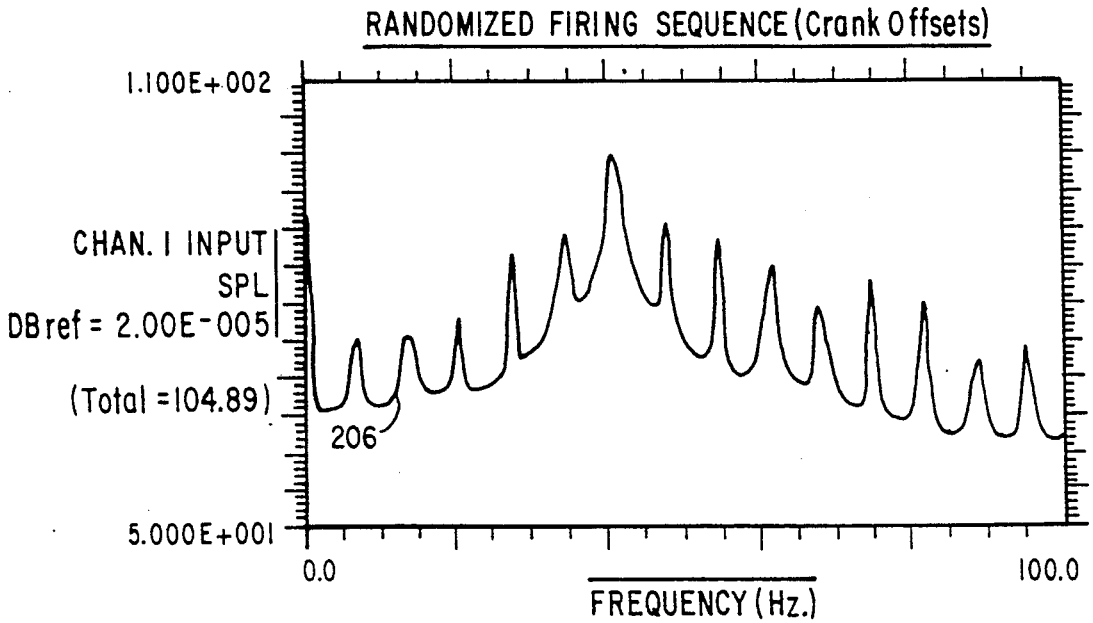
FIG. 7 is a computer generated frequency plot of the exhaust noise of an engine having a randomized firing sequence simulating crank pin offsets.

Referring now to FIG. 7, curve 206 represents an example of randomizing exhaust noise over an engine cycle, wherein the engine includes crank pins randomly offset over a range of ±18 degrees. The frequency spectrum plot produced by the simulation indicates that the energy associated with the primary firing frequency has been shifted to several of the rotational harmonics. Such a technique is effective in suppressing, disguising or altering the characteristic exhaust noise or acoustic signature of an engine.

Figure 8:
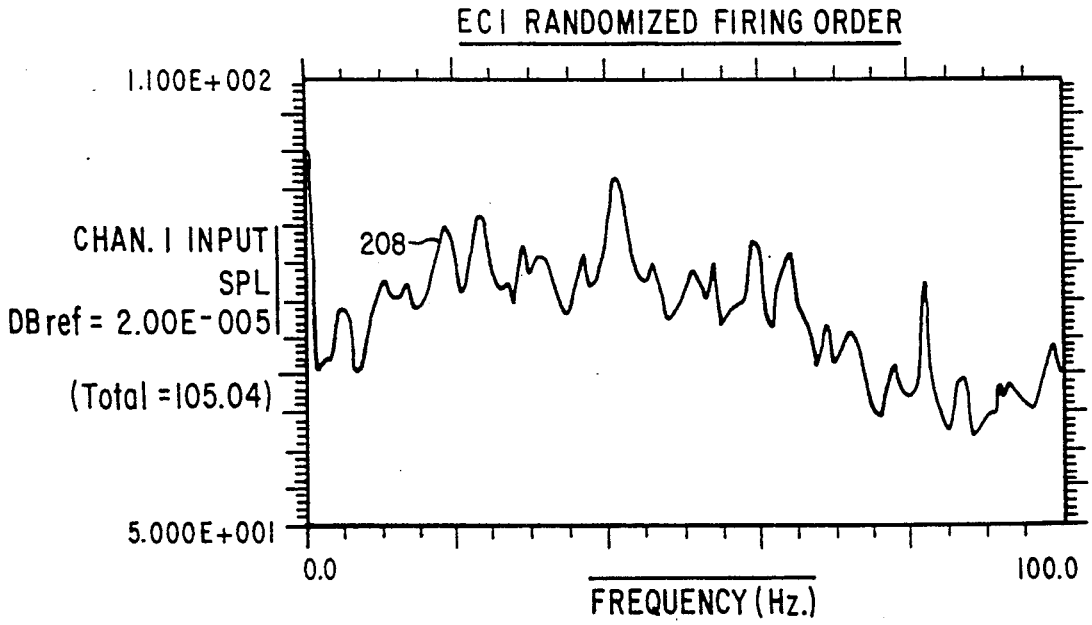
FIG. 8 is a frequency plot of exhaust noise for an engine having an electronically controlled ignition system providing randomized firing order to the cylinders.

Referring now to FIG. 8, laboratory simulations provide a frequency spectrum plot of the spectral noise energy produced by an engine which includes randomized firing order. Randomized firing order would include time-varying cutout of ignition signals or time-varying cutout of fuel delivery to cylinders in a random fashion to produce a non-periodic or aperiodic cylinder cutout sequence. As can be seen from curve 208, the energy has been dispersed over a broad range and numerous spectral peaks appear which cause the curve 208 of FIG. 8 to be radically removed from curve 202 or 204 of FIG. 6. The shifting of the energy into the different spectral regions of the graph of FIG. 8 indicates the effectiveness with which the acoustic signature of an engine can be altered using a randomized firing technique. The randomized firing technique is implemented over a single or multiple engine cycles.

Figure 9:
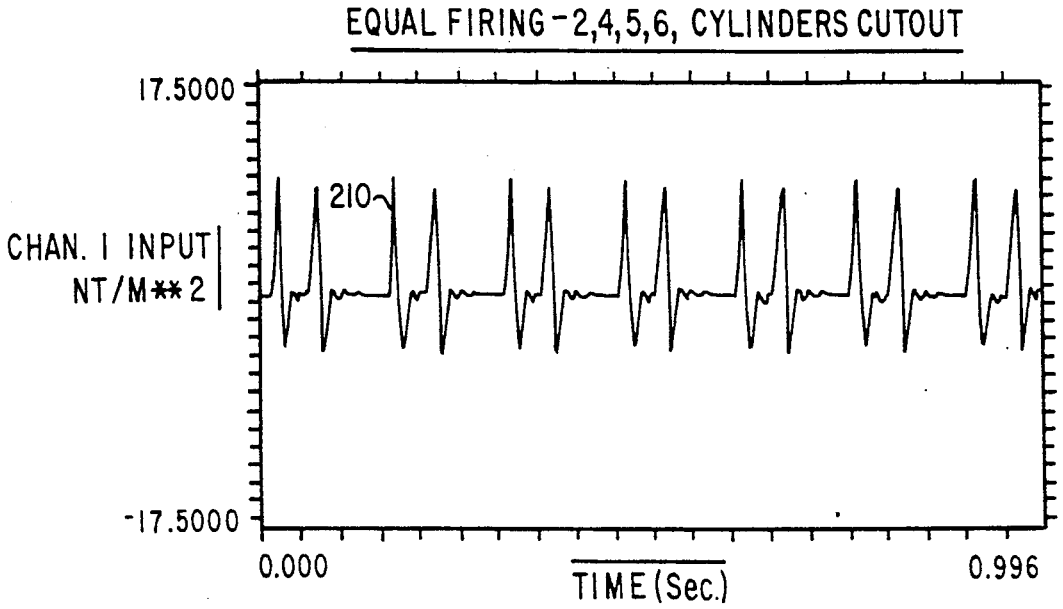
FIG. 9 is a graph of the exhaust noise produced by an equal firing six-cylinder engine with cylinders 2, 4, 5, and 6 cutout.
Figure 10:
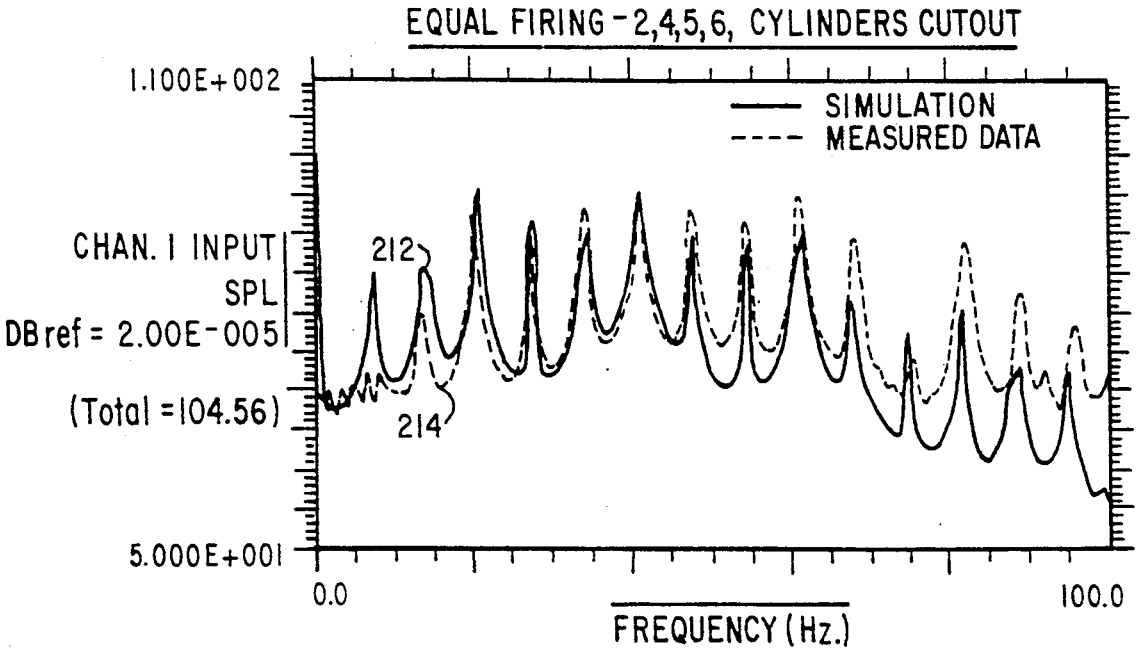
FIG. 10 is a frequency plot of two curves showing simulated and measured spectral composition of the time-varying signal shown in FIG. 9.

Referring now to FIG. 9, curve 210 illustrates the time domain noise (sound pressure) response of a six-cylinder engine having even firing, with cylinders 2, 4, 5, and 6 cut out. Again, by comparing the result of the time-to-frequency domain transformation of curve 210, FIG. 10 illustrates the simulated and measured spectral energy density present in the exhaust noise of an engine having cylinders 2, 4, 5, and 6 cut out. In comparing curves 212 and 214 with curves 202 and 204 of FIG. 6, it is apparent that cylinder cutout can radically alter the spectral composition of the exhaust noise produced by an engine, and thereby prevent easy recognition of the engine by enemy military personnel.

Figure 11:
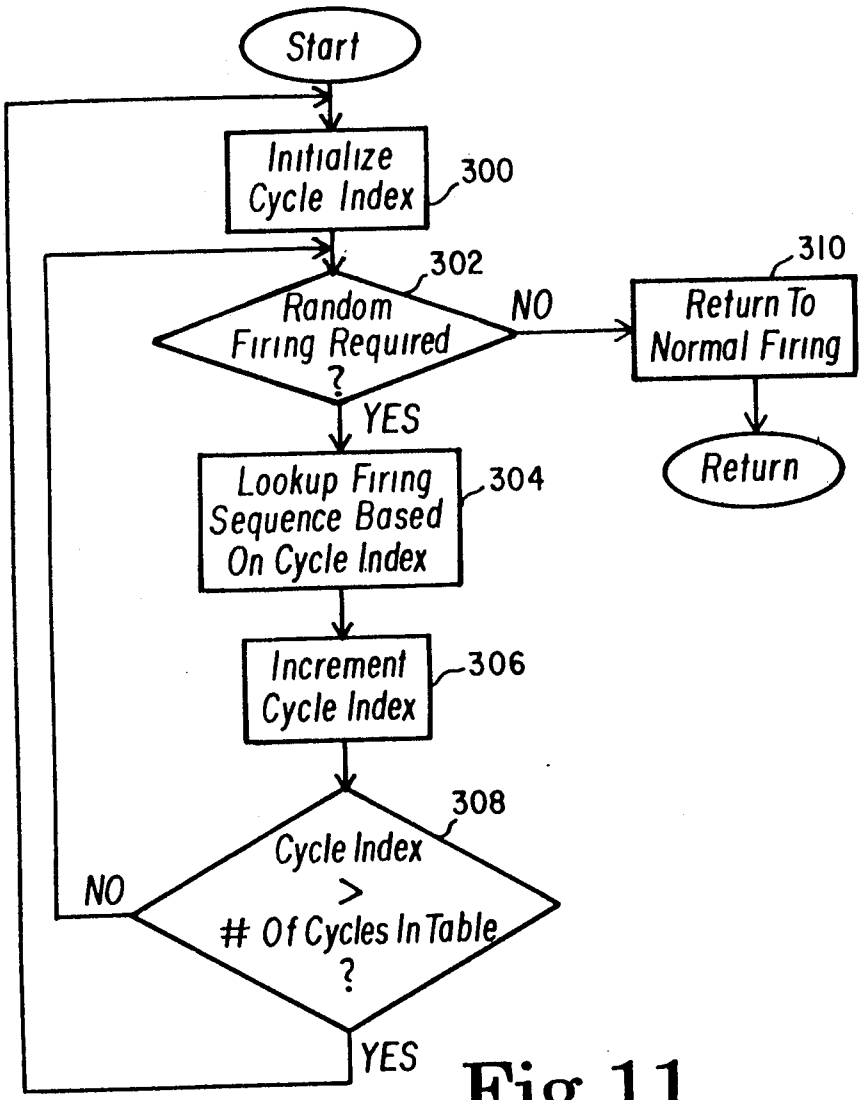
FIG. 11 is a flowchart for a pseudo-random cylinder cutout engine control subroutine.

Referring now to FIG. 11, a flowchart for a pseudo-random cylinder cutout engine control computer program subroutine is shown. At step 300, an engine cycle index counter is initialized in memory. Subsequently, at step 302, the inputs of the system are monitored by the ECM and pseudo-random firing is initiated if required according to the inputs sensed, i.e. RPM, load, power demand and cylinder cutout requested via an operator switch. If random firing is required at step 302, program execution continues at step 304 wherein a firing sequence lookup table is accessed by the program to determine which cylinder or cylinders will fire on the next engine cycle. See Table 1 for an example lookup table. In the case of a four-cycle engine, an engine cycle includes two full revolutions of the crankshaft, wherein all cylinders will fire if activated. The cycle index value is used as an index into the lookup table (see Table 1) to determine the active cylinders for the current engine cycle firing sequence. As each engine cycle is completed, the cycle index counter is incremented at step 306. At step 308, the cycle index is compared to a maximum value, based upon the number of cycles (n) defined in the lookup table. If the cycle index is greater than a predetermined value (n) or the length of the lookup table, then program execution returns to step 300 where the cycle index is reset to an initial value (here 1), and the pseudo-random firing sequence defined in Table 1 begins again. If at step 308 the cycle index is not greater than the number of cycles in the lookup table, then program execution continues at step 302 where the inputs again are tested to determine whether random firing is required. If at step 302 random firing is not required based upon the inputs to the ECM, then the ECM returns to a normal firing sequence at step 310 and program execution returns to a normal firing sequence program.

TABLE 1

| Cycle Index | Active Cylinders |
|---|---|
| 1 | 1,4,5 |
| 2 | 2,4,6 |
| 3 | 3,6 |
| 4 | 1,5 |
| 5 | 1,3,5 |
| . | . |
| . | . |
| . | . |
| n | |

Figure 12:
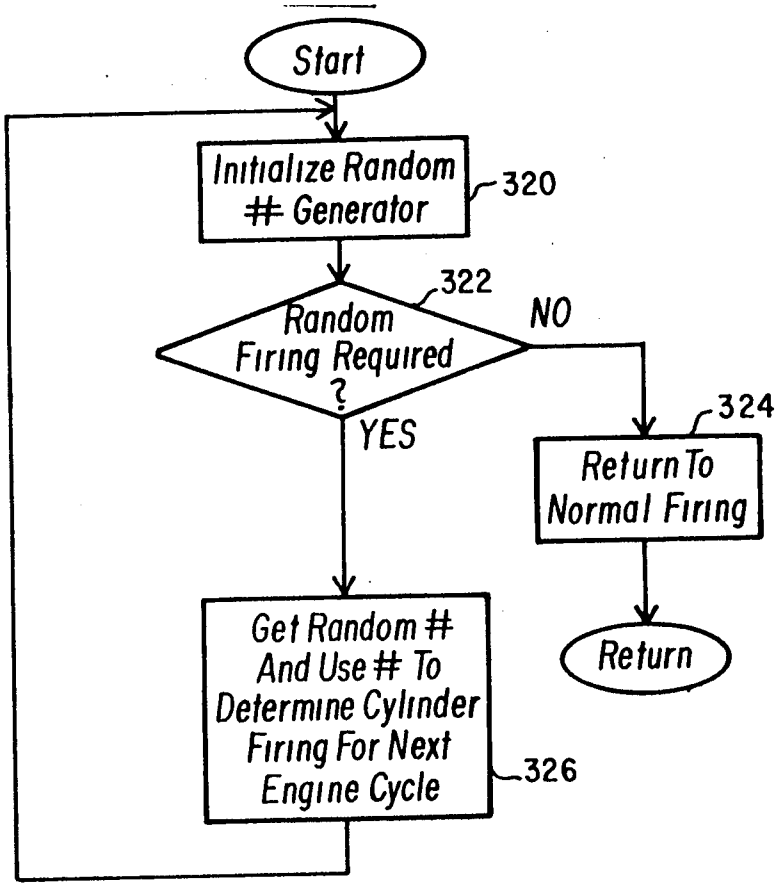
FIG. 12 is a flowchart for a true random cylinder cutout subroutine.

Referring now to FIG. 12, a flowchart for a true random cylinder cutout engine control computer program subroutine is shown. At step 320, a random number generator is initialized to begin production of random numbers. Subsequently at step 322, the inputs to the ECM are tested and a decision is made as to whether random firing is required based upon engine speed, load, power demand and operator requests for cylinder cutout operation. Random firing is essentially the converse of cylinder cutout wherein fuel or ignition signals are deprived from certain cylinders in order to deactivate or cutout their operation. If random firing is required at step 322, then step 326 is subsequently executed. At step 326, a random number is obtained from a random number generator and used to determine which cylinders will be cutout and which cylinders will be active or fire for the next engine cycle. As the random number generator can produce any quantity of random numbers within a particular range, it is readily seen that the engine firing cycle and cylinder cutout decisions can be randomized so that no recognizable acoustic signature will be produced by the engine. If at step 322 random firing is not required, program execution continues with step 324 where a return to normal firing sequence is requested, and subsequently the random cylinder cutout subroutine is terminated and program execution returns to the program or routine which invoked the random cylinder cutout subroutine.

It is also possible to alter an engine firing pattern via cylinder cutout so that the engine acoustically resembles another engine having a non-threatening acoustic signature. For example, if the firing order of an in-line six-cylinder engine is 1, 5, 3, 6, 2, 4, cylinder cutout of cylinders 5, 6, 2 and 4 results in an acoustic exhaust signature resembling that of an uneven firing vintage two-cylinder John Deere farm tractor. The result is the noise signature shown in FIGS. 9 and 10.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A device for altering the noise signature of a multi-cylinder internal combustion engine, said device comprising:

power output sensing means for producing a low-load signal when the power output request to said engine falls below a predetermined limit; and cylinder cutout means responsive to said low-load signal for pseudo-randomly disabling normal operation of the cylinders of said engine in a time-varying fashion to produce an aperiodic engine exhaust noise.

2. The device of claim 1 wherein said cylinder cutout means is an electronic ignition controller which momentarily disables engine ignition signals in a time-varying fashion to said cylinders.

3. The device of claim 2 including an enable switch connected to an input of said electronic ignition controller for enabling and disabling cylinder cutout operation of said electronic ignition controller.

4. The device of claim 3 wherein said fueling control means is an electronic fuel injection system.

5. The device of claim 3 wherein said fueling control means is a mechanical fuel injection system.

6. The device of claim 1 wherein said cylinder cutout means is a fueling control means for altering fuel delivery rates to the cylinders of the engine in a time-varying fashion.

7. The device of claim 1 including disabling means for disabling said power output sensing means from producing said low-load signal.

8. The device of claim 1 including disabling means for preventing said cylinder cutout means from responding to said low-load signal.

9. The devices of claims 2 or 4 wherein the internal combustion engine includes a crankshaft having offset crank pins angularly positioned to produce engine exhaust noise randomly dispersed over a broad frequency spectrum.

10. The device of claims 2 or 4 wherein said power output sensing means is a throttle position sensor which produces said low-load signal when a throttle position corresponding to an idle condition is detected.

11. A device for altering the noise signature of a multi-cylinder internal combustion engine including an ignition system comprising:

idle state sensing means for producing an idle signal when the engine is in an idle state of operation; and control means responsive to said idle signal for pseudo-randomly disabling the ignition system in a time-varying fashion to produce an aperiodic engine exhaust noise.

12. The device of claim 11 wherein said engine includes a throttle control connected to said engine and said idle speed sensing means includes a throttle position sensing means adapted to detect a throttle position corresponding to an idle state of operation and produce said idle signal in response thereto.

13. The device of claim 12 including means for sensing engine RPM for producing an idle speed signal when said engine speed is below a predetermined RPM, and wherein said idle state sensing means produces said idle signal in response to detection of said throttle position corresponding to an idle state of operation and said idle speed signal.

14. A device for altering the noise signature of an internal combustion engine including a fueling control system comprising:

idle state sensing means for producing an idle signal when the engine is operating in an idle state of operation; and control means responsive to said idle signal for pseudo-randomly disabling the fueling control system in a time-varying fashion to produce an aperiodic engine exhaust noise.

15. The device of claim 14 wherein the fuel injection system includes an injector for each cylinder of the engine and wherein said control means is an electronic control means which individually controls each of said injectors, said electronic control means randomly disabling and enabling said injectors in response to said idle signal.

16. A device for altering the noise signature of an internal combustion engine including a fueling control system comprising:

idle state sensing means for producing an idle signal when the engine is operating in an idle state of operation, wherein said idle state sensing means includes a tone wheel mounted on said engine and rotating in proportion to the speed of said engine, a magnetic sensor adapted to be mounted in magnetic relationship with said tone wheel, and speed circuit means responsive to an output signal from said magnetic sensor and producing said idle signal when the speed of said engine falls below a predetermined limit; and control means responsive to said idle signal for pseudo-randomly disabling the fueling control system in a time-varying fashion to produce an aperiodic engine exhaust noise.

17. A method for altering the acoustic signature of an internal combustion engine having a plurality of cylinders comprising the steps of:

detecting a low-load condition placed on the engine; and pseudo-randomly altering normal operation of at least one of said plurality of cylinders in a time-varying fashion in response to detecting said low-load condition to produce an aperiodic engine exhaust noise.

18. The method of claim 17 including the step of detecting a request for acoustic signature alteration.

19. The method of claim 17 wherein said pseudo-randomly altering step includes inhibiting ignition signals to said cylinders in a time-varying fashion.

20. The method of claim 17 wherein said pseudo-randomly altering step includes inhibiting fueling of one of said plurality of cylinders in a time-varying fashion.

21. The method of claim 20 wherein said inhibiting fueling step includes inhibiting actuation of a fuel injector associated with one of said plurality of cylinders.

22. The method of claim 20 wherein said inhibiting fueling step includes restricting fuel delivery to a fuel injector associated with one of said plurality of cylinders.

23. A device for altering the noise signature of a multi-cylinder internal combustion engine, said device comprising:

power output sensing means for producing a low-load signal when the power output request to said engine falls below a predetermined limit; and fueling control means responsive to said low-load signal for pseudo-randomly altering normal operation of the cylinders of said engine in a time-varying fashion to produce an aperiodic engine exhaust noise.

24. The device of claim 23 wherein said fueling control means includes an electronic control module which produces fueling signals for each cylinder of said engine in accordance with a load signal supplied to an input of said electronic control module and according to a pseudo-random control algorithm, and fuel injection means connected to said electronic control module for introducing fuel into the cylinders of said engine in accordance with said fueling signals.

* * * * *

UNITED STATES PATENT AND TRADEMARK OFFICE

CERTIFICATE OF CORRECTION

PATENT NO. : 5,042,444
DATED : August 27, 1991
INVENTOR(S) : Paul A. Hayes et al.

It is certified that error appears in the above-identified patent and that said Letters Patent is hereby corrected as shown below:

In column 1, line 27, change the word "cylinder" (first occurrence) to the word --cylinders--.

In column 1, line 30, change the word "knwon" to the word --known--.

Signed and Sealed this

Seventeenth Day of November, 1992

*Attest:*

DOUGLAS B. COMER

*Attesting Officer*

*Acting Commissioner of Patents and Trademarks*